US005127676A

United States Patent [19]

Bockairo

[11] Patent Number: 5,127,676

[45] Date of Patent: Jul. 7, 1992

[54] FOLDED LEAFLET LABEL

[75] Inventor: Frank J. Bockairo, Naugatuck, Conn.

[73] Assignee: CCL Label, Inc., Grand Rapids, Mich.

[21] Appl. No.: 660,533

[22] Filed: Feb. 25, 1991

[51] Int. Cl.[5] ..... B42D 15/00

[52] U.S. Cl. ..... 283/81; 283/56; 428/40; 428/42; 428/43

[58] Field of Search ..... 428/40, 41, 42, 43, 428/137, 138; 283/81, 105, 56, 903

[56] References Cited

U.S. PATENT DOCUMENTS

| | | | |
|---|---|---|---|
| 1,827,636 | 10/1293 | Ames | 428/43 X |
| 2,363,472 | 11/1944 | Ritter | 283/105 X |
| 3,226,862 | 1/1966 | Gabruk | 428/42 X |
| 3,524,782 | 8/1970 | Buske | 283/105 X |
| 4,529,229 | 7/1985 | Glibbery | 283/81 |
| 4,621,837 | 11/1986 | Mack | 283/105 |
| 4,711,686 | 12/1987 | Instance | 283/105 X |
| 4,726,972 | 2/1988 | Instance | 283/105 X |
| 4,744,161 | 5/1988 | Instance | 283/81 X |
| 4,747,618 | 5/1988 | Instance | 281/5 |
| 4,773,584 | 9/1988 | Instance | 229/74 |
| 4,846,504 | 7/1989 | MacGregor et al. | 283/102 |
| 4,850,613 | 7/1989 | Instance | 281/5 |
| 4,965,113 | 10/1990 | Jones et al. | 428/40 |

FOREIGN PATENT DOCUMENTS 654529 2/1986 Switzerland .

*Primary Examiner*—Paul A. Bell

*Attorney, Agent, or Firm*—Warner, Norcross & Judd

[57] ABSTRACT

An adhesive label is disclosed having a folded leaflet, coupon, or the like disposed between a base sheet and a cover sheet. The cover sheet is wider than the folded leaflet, having side edges peelably adhered to the base sheet. The cover sheet has at least one end edge extending outwardly beyond the ends of the sides edges so as to form tabs which are readily grasped for peeling away the cover sheet for access to the cover sheet. The label is disclosed in circular and rectangular embodiments. The end areas of the cover sheet side edges may be tapered to reduce the possibility of tearing the cover sheet.

15 Claims, 2 Drawing Sheets

FOLDED LEAFLET LABEL

BACKGROUND OF THE INVENTION

1. Field of the Invention

The present invention relates to a label having a folded leaflet, coupon, or the like, and, more particularly, to such a label in which the leaflet may be readily peeled away from the label.

2. Description of the Related Art

It is known in the art to provide a pressure sensitive adhesive label including a base sheet, a cover sheet, and a folded leaflet, coupon, or the like disposed between the cover sheet and the base sheet. The label is adhered to a product or container, and the leaflet is accessed by peeling away the cover sheet.

U.S. Pat. 4,747,618, issued May 31, 1988, is representative of the prior art, and discloses a rectangular adhesive label having a base sheet, a transparent cover sheet, and a folded leaflet adhered to pressure sensitive adhesive on the underside of the cover sheet. The cover sheet is wider than the folded leaflet, such that a pair of opposite edges of the cover sheet are adhered to the base sheet. The other pair of edges, which are not adhered to the base sheet, are coextensive with the leaflet edges and extend in straight lines between the ends of the adhered edges. The cover sheet is lifted to expose and unfold the leaflet.

Labels of this type are frequently relatively small, and are closely adhered to the surface of a box, bottle, or similar consumer product container. To facilitate the removal of the leaflet, it is important that the non-adhered edges of the cover sheet be easily graspable. However, as described above, the labels of the prior art have been formed with the non-adhered edges of the cover sheet not extending beyond a boundary line defined between the ends of the adhered edges. Thus, the non-adhered edges tend to be held tightly against the package and are not easily grasped. To address this problem, labels of the prior art have formed the cover sheet with weakened tear lines along one or both of the adhered edges. This solution is not entirely satisfactory in that it is still difficult to grasp an edge of the cover sheet, an extra manufacturing step is needed to form the tear lines, and the label may be prematurely and unintentionally torn due to the weakness of the tear line.

Thus, there is an unmet need for a folded leaflet label having an easily grasped and removed cover sheet that is economically manufactured yet which resists tearing and unintended removal.

SUMMARY OF THE INVENTION

The present invention fulfills the aforemetioned unmet need by providing a folded leaflet label in which a cover sheet has non-adhered edges that extend beyond the boundary line defined between the ends of the adhered edges of the cover sheet. In this manner, the non-adhered edges form free tabs which are easily flexed upward for grasping and removal of the cover sheet.

In one embodiment of the invention, the label base sheet is round, or circular and the cover sheet has two parallel, opposed straight side edges the ends of which are spanned by arcuate end edges coextensive with the base sheet. The straight side edges extend beyond the edges of a folded leaflet or the like under the cover sheet and are peelably adhered to the base sheet. The arcuate end edges of the cover sheet extend beyond a boundary line defined between the ends of the straight edges so as to form a graspable tab.

Also in this embodiment, the end areas of the cover sheet edge portions adhered to the base sheet are each tapered to a point. This tapering provides a very narrow area of adhesion in which peeling of the cover sheet from the base sheet may be initiated. The area of adhesion gradually widens as the cover sheet is progressively peeled away until the full widths of the edge portions are being peeled. This gradual increase in width of the peeling area serves to avoid tearing of the cover sheet.

In another embodiment of the invention, the label is formed in a generally rectangular shape with one or both of the non-adhered edges of the cover sheet extending beyond the ends of the adhered edges, thus forming one or two graspable tabs.

These and other objects, advantages, and features of the present invention will be more fully understood and appreciated by reference to the written specification and appended drawings.

DESCRIPTION OF THE PREFERRED EMBODIMENT

Figure 1:
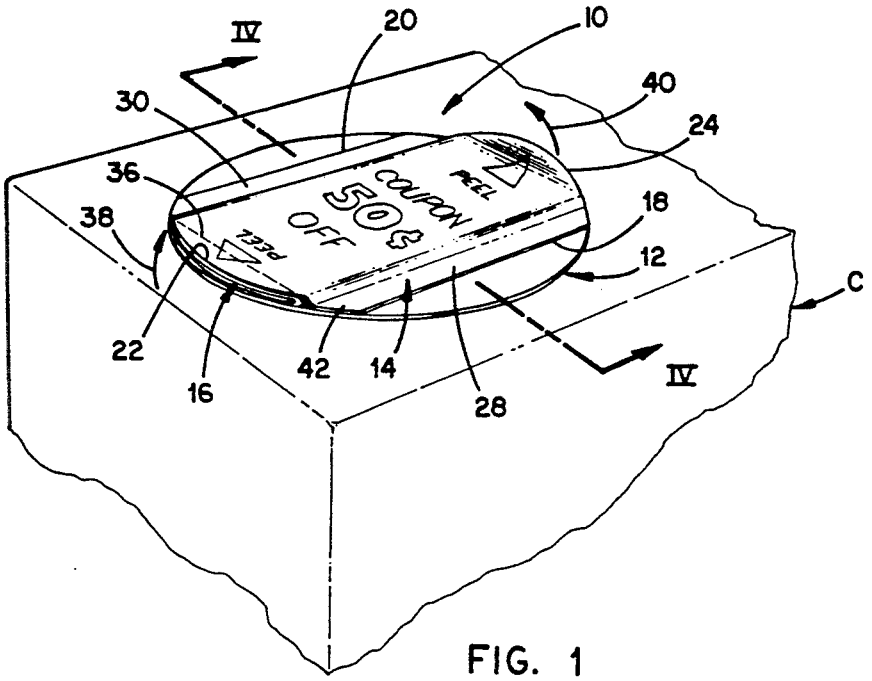
FIG. 1 is a perspective view of a folded leaflet label according to the principles of the invention adhered to a product container.
Figure 4:
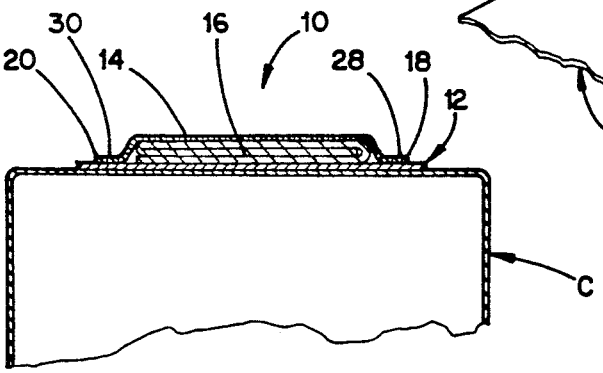
FIG. 4 is a sectional view taken along the line 4—4 of FIG. 1.

By way of disclosing a preferred embodiment, and not by way of limitation, there is shown in FIGS. 1 and 4 a folded leaflet label 10 adhered to the outer surface of a product container C. In its general organization, the label 10 includes a base sheet 12, a cover sheet 14, and a leaflet comprising a folded strip 16 disposed between the base sheet and the cover sheet. The label is preferably initially provided with a silicone-coated release liner peelably adhered to the underside of the base sheet. In a well known fashion, the release liner is removed from the base sheet to expose a coating of pressure sensitive adhesive on the underside of the base sheet. The label is then applied to the container and held thereon by the pressure sensitive adhesive.

The folded strip 16 is folded in against itself in thirds along two transverse fold lines. The folded strip 16 is shown as a cents-off coupon for the product in the container. Typically, the coupon is preprinted with information identifying the product and the amount of the discount. Alternatively, the folded strip may comprise an instruction sheet, an advertising leaflet, or any other printed material. It is to be understood that the present invention is not to be taken as limited in scope to a cents-off coupon.

The base sheet 12 is circular and has a diameter greater than the width of the folded strip 16. The cover sheet 14 has two generally straight and parallel opposed side edges 18, 20, and two arcuate end edges 22, 24 extending between the ends of the side edges 18, 20 generally coextensive with arc segments of the circumference of the base sheet 12 and with the outer edges of the folded strip.

Figure 3:
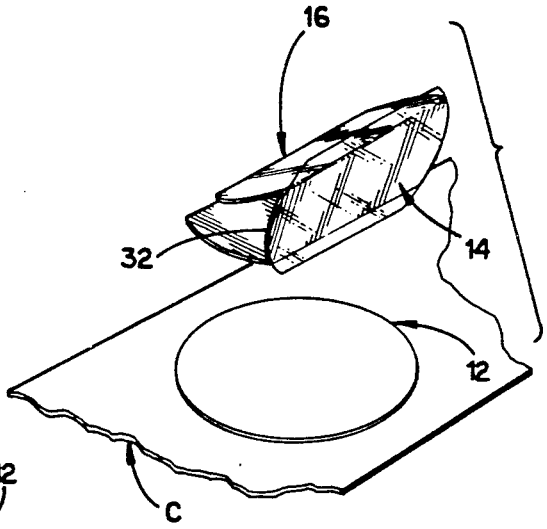
FIG. 3 is a perspective view showing the removal and unfolding of the cover sheet and label from the base sheet.

The width of the cover sheet 14 is greater than the folded width of the folded strip 16 but less than the diameter of the base sheet 12. Both the cover sheet and the folded strip are disposed along a laterally central portion of the base sheet. Consequently, two side edge portions 28, 30 of the cover sheet extend laterally beyond the fold lines of the folded strip 16 straddling the folded strip and directly overlying the base sheet. The entire underside of the cover sheet 14 is coated with a pressure sensitive adhesive. As shown in FIG. 3, the central panel 30 of the folded strip 16 adheres to the central region of the cover sheet 14. Preferably, the cover sheet is made of a transparent material so that printing on the folded strip will be visible. A preferred material for the cover sheet is polypropylene. Alternate materials include polyester or polystyrene.

Referring again to FIG. 1, the undersurfaces of the cover sheet edge portions 28 are also coated with pressure sensitive and overlyingly adhere to the base sheet 12. Preferably, the adhesive materials used are selected so that the degree of adhesion between the cover sheet and the base sheet is less than the degree of adhesion between the base sheet and the container surface. In this manner, the cover sheet and coupon may be removed from the base sheet without removing the base sheet from the container. Suitable materials are well known in the art.

Figure 2:
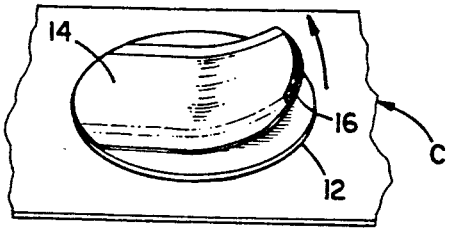
FIG. 2 is a perspective view showing the cover sheet and leaflet of the label of FIG. 1 being removed from the base sheet.

The arcuate end edges 22 and 24 of the cover sheet 14 extend beyond a boundary line extending between the ends of the cover sheet side edges 28, 30. One such boundary line is indicated at broken line 36. In this manner, the portions of the cover sheet disposed outwardly of these boundary lines constitute tabs which may be readily flexed away from the base sheet as indicated by arrows 38, 40. After such flexing, the tabs may be easily grasped and pulled for peeling and removal of the cover sheet and folded strip from the base sheet. The progress of the removal of the cover sheet and folded strip is shown in FIGS. 2 and 3.

Removal of the cover sheet from the base sheet without tearing of cover sheet is facilitated by the tapering of the ends of the cover sheet edge portions 28, 30. As shown at 42 in FIG. 1, the end areas of the edge portions are gradually reduced in width as the junctures of the edge portions with the arcuate ends 22, 24 are approached. Consequently, when the cover sheet is removed, peeling of the adhering portions of the cover sheet to the base sheet is initiated in very narrow areas without tearing of the cover sheet. The width of the peeling areas is gradually increased as peeling progresses, also without tearing, until the full widths of the cover sheet edge portions are being peeled off.

Figure 5:
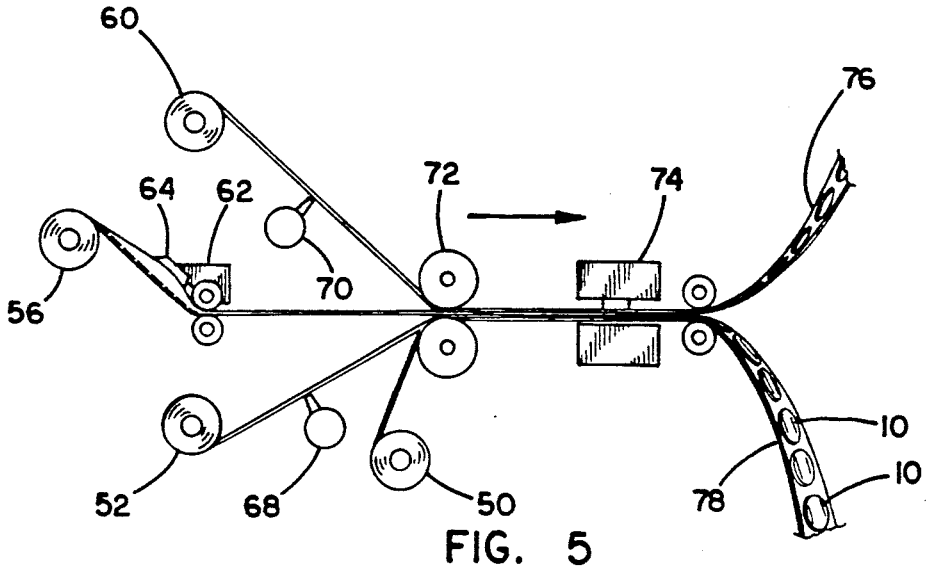
FIG. 5 is a diagrammatic view illustrating an apparatus and method for manufacturing the label according to the invention.

An apparatus and method for manufacturing the label according to the invention are illustrated in FIG. 5, in which a continuous web of release liner is formed with a series of labels adhered thereto. Rolls of continuous webs or strips of release liner 50, base sheet 52, leaflets 56, and cover sheet 60 materials are provided at the infeed end of the apparatus. The web of leaflets 56 is pre-printed with a repeated series of coupons, advertising, or the like, spaced apart along the length of the web. Alternatively, if desired, the printing of the leaflets may be carried out with printing devices integrated with the label manufacturing apparatus. The leaflet web 56 is unrolled and drawn through a folding device 62 which folds the web into thirds, fourths, or any other desired number of folds. Such folding devices are well known and are frequently referred to as "plow" folders due to the shape of the mandrel 64 around which the web is folded.

Beneath the leaflet web, a web of base sheet 52 is unrolled. A coater 68 places a coating of pressure sensitive adhesive on the underside of the base sheet. Beneath the web of base sheet, a web of release liner 50 is unrolled.

Above the leaflet web, a web of cover sheet material 60 is unrolled. A coater 70 places a coating of pressure sensitive adhesive on the underside of the cover sheet web.

The cover sheet, leaflet, base sheet, and release liner webs are longitudinally aligned and pass between pressure rolls 72 which adhere the release liner to the underside of the base sheet, and further adhere the folded leaflet web to the central portion of the underside of the cover sheet. Furthermore, the edge portions of the cover sheet are adhered to the base sheet straddling the edges of the leaflet web.

The assembled layers of the cover sheet, leaflets, base sheet and release liner then advance through a die cutter 74 which cuts through all the layers except for the release liner in registration with the printing on the leaflets. The unused portions of the cover sheet, leaflet web, and base sheet are pulled away in a strip 76 for disposal or recycling. The finished web of labels 78 is coiled or folded and delivered for application of the labels 10 to product containers or the like.

Figure 6:
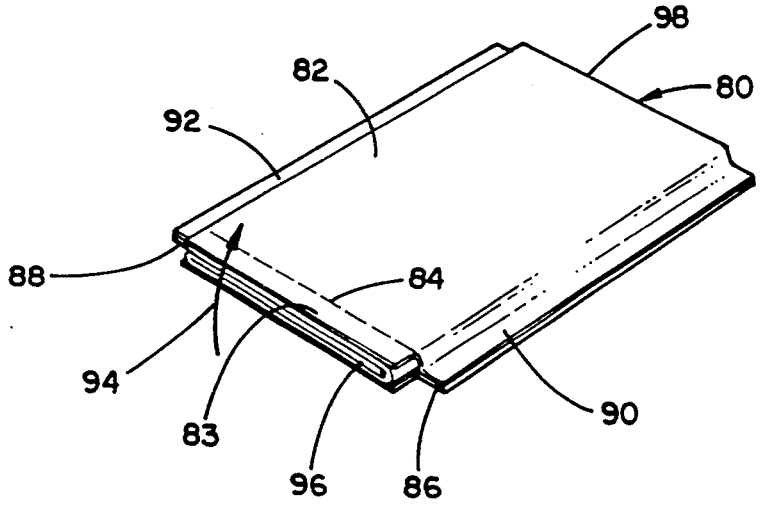
FIG. 6 is a perspective view showing an alternate embodiment of a label according to the invention.

An alternate embodiment of the label according to the invention is shown in FIG. 6. In this embodiment, the label 80 is generally rectangular in outline. The cover sheet 82 at one end has a tab portion 83 which extends beyond a boundary line 84 extending between the ends 86, 88 of the side portions 90, 92 of the cover sheet. As with the embodiment of FIG. 1, the tab 83 may be readily flexed upward as indicated by arrow 94 for grasping of the tab and the folded strip 96. If desired, a similar tab portion may be formed at the opposite end 98 of the label.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A label comprising:

a round base sheet having first and second surfaces;

a cover sheet having first and second spaced apart, opposed side edges, and first and second spaced apart, opposed end edges extending between the outwardly disposed ends of said first and second side edges, side edge portions of said cover sheet adjacent said side edges being overlyingly, peelably adhered to said base sheet first surface;

a folded strip disposed between said base sheet and said cover sheet straddled by said cover sheet side edge portions;

at least one of said cover sheet end edges being arcuate and overlyingly coextensive with arc segments of the circumference of said base sheet, said at least one cover sheet end edge extending outwardly beyond the ends of said first and second side edges so as to form a tab means for grasping and peeling of said cover sheet from said base sheet to expose said folded strip.

2. The label of claim 1 wherein the width of said cover sheet between said side edges is less than the width of said base sheet.

3. The label of claim 1 further comprising tapered end areas of said cover sheet side edge portions disposed adjacent said tab means.

4. A label comprising:

a round base sheet having first and second surfaces, said first surface coated with adhesive and adapted for overlying adhesion to a product container;

a folded, indicia-bearing strip overlying a central portion of said base sheet second surface having folded edges spaced inwardly from opposed portions of the circumference of said base sheet; and a cover sheet overlying said folded strip and having first and second spaced apart, generally parallel side edges and side edge portions extending between outwardly disposed ends thereof and beyond the folded edges of said folded strip and straddling said folded strip, the under surface of said cover sheet coated with a pressure sensitive adhesive, said side edge portions overlyingly, peelably adhered to said base sheet second surface, said cover sheet further having first and second spaced apart arcuate end edges extending between said ends of said side edges overlyingly coextensive with arc segments of the circumference of said base sheet and disposed outwardly of boundary lines extending between said side edge ends thereby forming two tab means by which said cover sheet may be grasped and peeled from said base sheet for access to said folded strip.

5. The label of claim 4 wherein the width of said cover sheet between said side edges is less than the diameter of said base sheet.

6. A label comprising:

a base sheet having first and second surfaces;

a cover sheet having first and second spaced apart, opposed side edges, and first and second spaced apart, opposed end edges extending between the outwardly disposed ends of said first and second side edges, side edge portions of said cover sheet adjacent said side edges being overlyingly, peelably adhered to said base sheet first surface, said side edge portions having tapered end areas;

a folded strip disposed between said base sheet and said cover sheet straddled by said cover sheet side edge portions;

at least one of said cover sheet end edges extending between and outwardly beyond the tapered end area of said first and second side edges so as to form a nonadhered tab means for grasping and peeling of said cover sheet from said base sheet to expose said folded strip.

7. The label of claim 6 wherein both of said cover sheet first and second end edges extend outwardly beyond the ends of said cover sheet first and second side edges, thereby forming two of said tab means.

8. The label of claim 6 wherein said at least one cover sheet end edge is arcuate.

9. The label of claim 8 wherein said base sheet is substantially circular, both of said cover sheet end edges being arcuate and overlyingly coextensive with arc segments of the circumference of said base sheet.

10. The label of claim 9 wherein the width of said cover sheet between said side edges is less than the width of said base sheet.

11. A label comprising:

a base sheet having first and second surfaces, said first surface coated with adhesive and adapted for overlying adhesion to a product container;

a folded, indicia-bearing strip overlying a central portion of said base sheet second surface having folded edges spaced inwardly from opposed portions of the circumference of said base sheet; and a cover sheet overlying said folded strip and having first and second spaced apart, generally parallel side edges and side edge portions extending between outwardly disposed ends thereof and beyond the folded edges of said folded strip and straddling said folded strip, each side edge portion having at least one tapered end, the undersurface of said cover sheet coated with a pressure sensitive adhesive, said side edge portions overlyingly, peelably adhered to said base sheet second surface, said cove sheet further having first and second spaced apart end edges extending between said ends of said side edges, at least one of said end edges disposed outwardly of a boundary line extending between said tapered ends of said side edge end portions thereby forming a nonadhered tab means by which said cover sheet may be grasped and peeled from said base sheet for access to said folded strip, whereby peeling of the cover sheet from said base sheet is effected over a gradually widening area.

12. The label of claim 11 both of said cover sheet end edges are disposed outwardly of boundary lines extending between said side edge ends thereby forming two tab means.

13. The label of claim 12 wherein said cover sheet end edges are arcuate.

14. The label of claim 13 wherein said base sheet is substantially circular, said cover sheet end edges being overlyingly coextensive with arc segments of the circumference of said base sheet.

15. The label of claim 14 wherein the width of said cover sheet between said side edges is less than the diameter of said base sheet.

* * * * *